United States Patent [19]

Hazelett et al.

[11] 3,963,068

[45] June 15, 1976

[54] SYMMETRICAL SYNCHRONIZED BELT-STEERING SYSTEM AND APPARATUS FOR TWIN-BELT CONTINUOUS METAL CASTING MACHINES

[75] Inventors: Robert William Hazelett, Winooski; John Frederick Barry Wood, Burlington; Robert J. Carmichael, Colchester, all of Vt.

[73] Assignee: Hazelett Strip-Casting Corporation, Winooski, Vt.

[22] Filed: Apr. 21, 1975

[21] Appl. No.: 570,208

Related U.S. Application Data

[62] Division of Ser. No. 350,600, April 12, 1973, Pat. No. 3,878,883.

[52] U.S. Cl. ..... 164/278

[51] Int. Cl.[2] ..... B22D 11/06

[58] Field of Search ..... 164/278; 226/18, 21, 226/23, 172, 22, 180; 74/242.1 A, 242.16, 242.14; 198/202, 208

[56] References Cited

UNITED STATES PATENTS

| | | | |
|---|---|---|---|
| 2,619,222 | 11/1952 | Przybylski | 198/208 X |
| 3,167,830 | 2/1965 | Hazelett | 164/278 |
| 3,399,582 | 9/1968 | Henry | 74/242.16 X |
| 3,407,673 | 10/1968 | Slezak | 226/23 X |
| 3,680,446 | 8/1972 | James et al. | 226/22 X |
| 3,702,131 | 11/1972 | Stokes | 198/202 |

*Primary Examiner*—Francis S. Husar
*Assistant Examiner*—John S. Brown
*Attorney, Agent, or Firm*—Parmelee, Johnson & Bollinger

[57] ABSTRACT

A symmetrical belt-steering and tensioning system and apparatus for twin-belt continuous metal casting machines are disclosed. A rigid squaring shaft passes through a hollow tension and steering roll and is rigidly secured to torque arms at opposite ends of the roll assuring that this roll remains parallel with the driving roll at the other end of the carriage throughout the range of tensioning travel, these arms each being associated with tension thrust means and steering means. The geometrical relationships assure that tension in the casting belts remains essentially directly proportional to the fluid pressure in the thrust cylinders, while a pre-loading arrangement removes back lash from the pivots to improve steering precision and also provides mechanical advantage. A symmetrical synchronized steering action is applied to both ends of the tension-steering roll, and axial thrust control means operate to force the roll skewing movement to center at a predetermined point. Independent adjustment of the displacement of each end of the tension-steering roll from the pass line is provided by sleeves associated with the squaring shaft and bearings in the interior of the hollow roll. A high belt tension force can be applied because there are two main large diameter rolls at opposite ends of each carriage defining the belt path as a symmetrical oval shape. Wide casting belts of 116 inches in width or more are precisely steered and tensioned for continuously casting slabs 100 inches or more in width.

4 Claims, 19 Drawing Figures

16
18
U
C
12
14
30
L
20
22
28

(INBOARD)

(INBOARD)

(INBOARD)

(INBOARD)

(INBOARD)

Fig. 10.
(OUTBOARD)
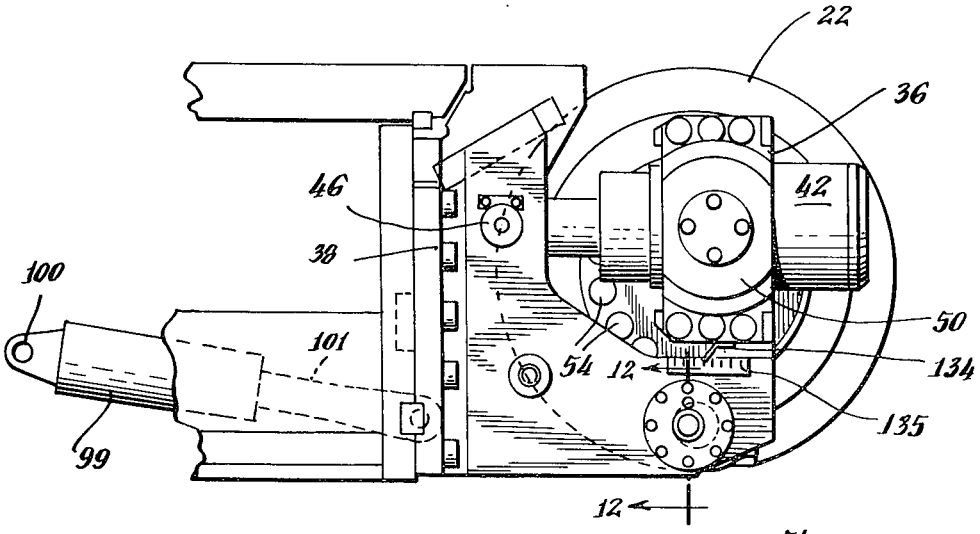
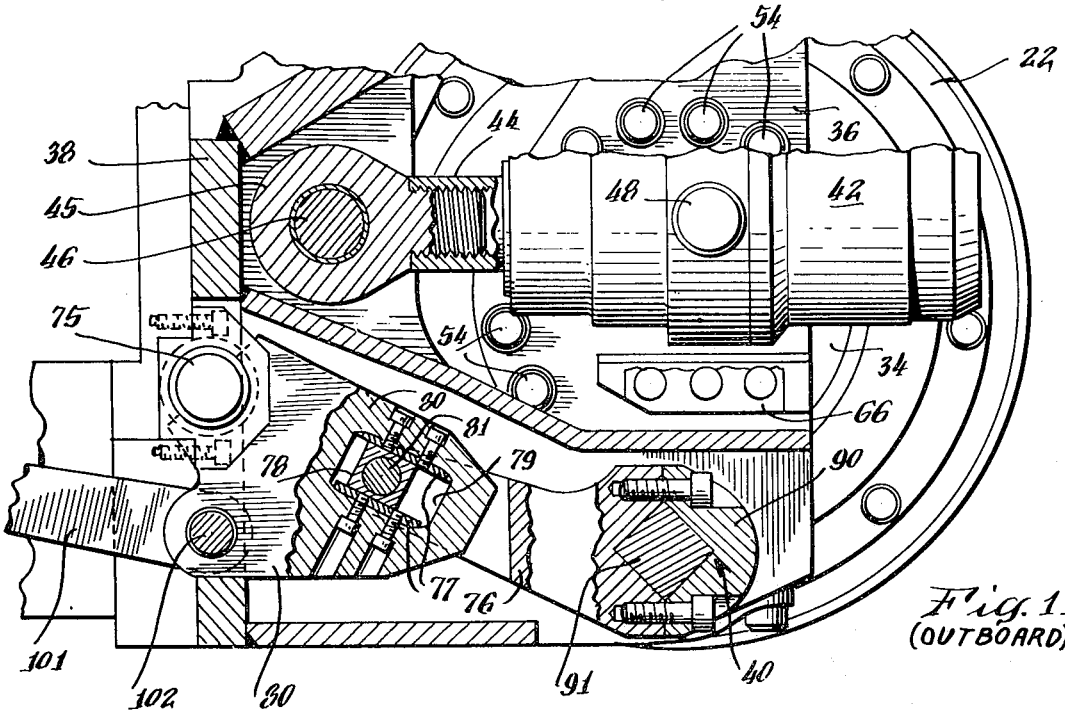
Fig. 11.
(OUTBOARD)
Fig. 12.
(OUTBOARD)
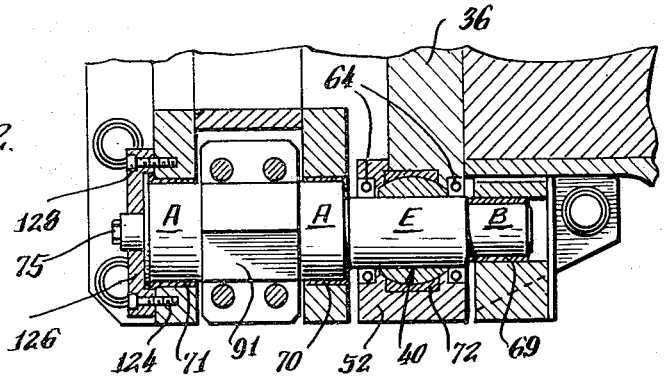

(OUTBOARD)

SYMMETRICAL SYNCHRONIZED BELT-STEERING SYSTEM AND APPARATUS FOR TWIN-BELT CONTINUOUS METAL CASTING MACHINES

This is a division, of application Ser. No. 350,600 filed Apr. 12, 1973 and now U.S. Pat. No. 3,878,883.

DESCRIPTION

This invention relates to a symmetrical synchronized belt-steering and tensioning system and apparatus for wide twin-belt continuous metal casting machines.

Such twin-belt casting machines use a pair of thin, wide endless metal casting belts to define the upper and lower surfaces of the region in which molten metal is confined as it is being solidified.

There have been earlier twin-belt continuous metal casting machines, for example, as shown in U.S. Pats. Nos. 2,640,235; 2,904,860; 3,036,348; 3,041,686; 3,123,874; 3,142,873; 3,167,830; 3,228,072; and 3,310,849. As time has passed, the operating requirements for these twin-belt casting machines have become progressively more demanding because it is desired that larger and larger cast sections, including wide cast sections, be produced with great accuracy. The present invention enables twin-belt continuous casting machines to be built in larger widths and sizes than were previously attained.

In a twin-belt casting machine the upper and lower casting belts are revolved around cantilevered upper and lower carriages carrying main rolls for these belts. These main rolls perform the functions of driving, tensioning and steering the belts.

Among the many advantages of the present invention are those resulting from the fact that it enables the same roll to be used both for tensioning and steering. A rigid squaring shaft passes through a hollow tension-steering roll and is rigidly secured to a pair of rigidly aligned torque arms at opposite ends of the roll. These arms are associated with dual tension thrust means and dual steering means arranged to provide symmetrical synchronized steering action and tensioning movement of the tension-steering roll. Only two large diameter main rolls are used at opposite ends of each carriage, one being the belt-driving roll and the other the tensioning-steering roll. Thus, the belt path is defined as a symmetrical oval shape and a high tension force is applied to the belts to provide an accurate wide mold under operating conditions.

The advantageous geometrical relationships provided in the system and apparatus embodying this invention assure that the tension in the casting belts remains essentially directly proportional to the fluid pressure in the tension thrust cylinders. In addition, a preloading arrangement removes back-lash from the pivots to improve the steering precision. A mechanical advantage is also provided whereby the tension thrust applied to the tension-steering roll is greater than the thrust exerted by the dual thrust means.

Other advantages of the present invention result from the fact that equal and opposite synchronized skewing movements are applied to the pivots of the two rigidly aligned torque arms at opposite ends of the squaring shaft, while axial thrust control means cause the roll skewing movement to center at a predetermined point providing symmetrical skewing movement of the roll itself.

Each end of the tension-steering roll can be independently adjusted to displace the tension-steering roll axis with respect to the axis of the squaring shaft for setting the clearance of the roll circumference from the pass line of the cast product. These adjustments are provided by sleeves associated with the squaring shaft and the bearings in the interior of the hollow roll.

For convenience of servicing the tension-steering roll and squaring shaft assembly can be removed and reinstalled as a complete unit.

The various features, aspects and advantages of the present invention will be more fully understood from a consideration of the following description of a twin-belt continuous metal casting machine embodying the invention, considered in conjunction with the accompanying drawings, in which:

BRIEF DESCRIPTION OF THE DRAWINGS

FIG. 9 also shows a portion of the downstream end of the frame of the lower carriage;

FIG. 10 is an elevational view of the apparatus as seen from the left in FIG. 3; that is, an elevational view of the outboard end;

FIG. 11 is an enlarged cross-sectional view taken along the line 11—11 in FIG. 3 looking toward the right;

FIG. 12 is a cross-sectional view through the outboard tension pivot taken along the line 12—12 in FIG. 10 looking toward the left;

DETAILED DESCRIPTION

Figure 1:
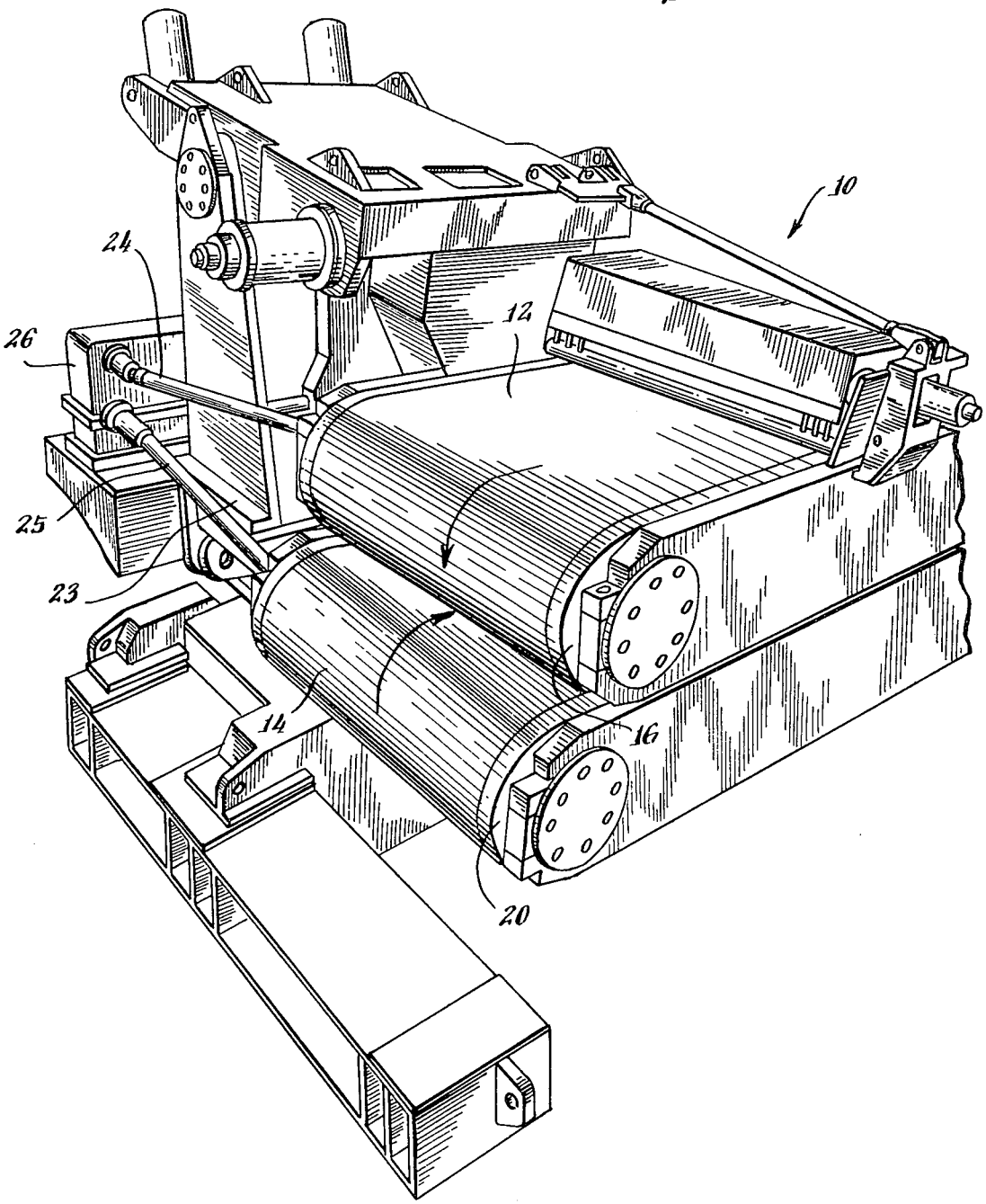
FIG. 1 is a perspective view of the input or upstream end of a continuous strip-casting machine embodying the present invention, as seen looking toward the machine from a position in front and beyond the outboard side of the two belt carriages.

In the continuous casting machine 10, which is shown in the drawings as an illustrative example of the present invention, molten metal is fed into the upstream end or entry of the machine between upper and lower endless, flexible casting belts 12 and 14. The molten metal is solidified in a casting region C (FIG. 2) defined by the spaced parallel surfaces of the upper and lower casting belts 12 and 14.

Figure 2:
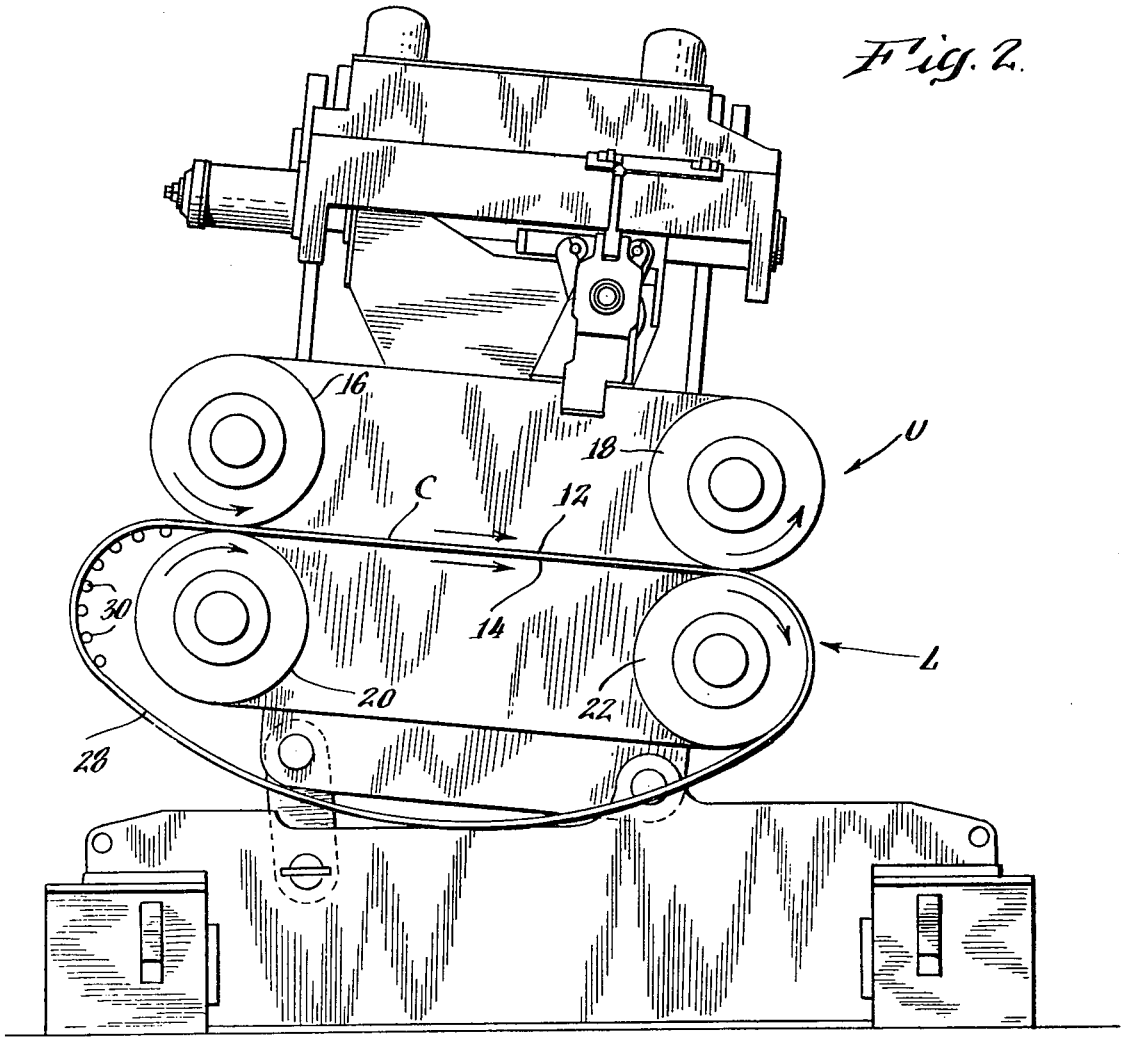
FIG. 2 is an elevational view of the machine as seen looking toward the outboard sides of the two belt carriages.

The two casting belts 12 and 14 are supported and driven by means of upper and lower carriage assemblies which are indicated in FIGS. 1 and 2 at U and L, respectively. The carriage assemblies are supported in cantilevered relationship from a main frame 23, as seen in FIG. 1. Hence the sides of the carriage assemblies near this main frame are referred to as being "inboard", while the other sides are referred to as "outboard".

The upper carriage includes two main pulley rolls 16 and 18 (FIG. 2) around which the casting belt 12 is revolved as indicated by the arrows. The roll 16 near the input end of the machine is referred to as the upstream roll or nip roll and the other roll 18 is called the downstream or tension roll. Similarly, the lower carriage L includes main upstream (or nip) and downstream pulley rolls 20 and 22, respectively, around which the lower casting belt 14 is revolved.

In order to drive the casting belts 12 and 14 in unison, the upstream or nip pulley rolls 16 and 20 of both the upper and lower carriages are jointly driven through universal spindles 24 and 25 and a mechanically synchronized drive 26 by an electrical drive motor (not shown). During the casting operations, the upper carriage assembly U is supported on the lower carriage assembly L through gauge spacers located at four corner support points, and the precise thickness of these four gauge spacers establishes the mold thickness dimension between the opposed casting faces of the casting belts 12 and 14 and correspondingly the resulting cast metal thickness. Two strands of closely fitting edge dams 28 (only one is seen in FIG. 2) are interposed between the opposed casting faces of the casting belts and are guided and laterally contained to establish the cast metal width at the nip or upstream end of the casting machine by the edge dam guide assemblies 30. These two strands of edge dams are driven through frictional contact with the driven lower casting belt 14. The two opposed inner casting faces of these edge dam assemblies 28, together with the two opposed casting faces of the upper and lower casting belts 12 and 14 form four synchronized casting faces of a moving mold C.

In order to cast a metal section accurately and with excellent surface quality, the two casting belts 12 and 14 must be maintained under a high tension force which is uniform across the full width of the casting belt, for example, which may be more than 100 inches in width in the illustrative machine 10. These casting belts are relatively thin metal belts, for example, of steel and it requires a great total tension force to achieve the desired effect.

In addition, these belts usually must be steered to keep them centered in the desired operating position on the carriages.

The apparatus for tensioning and steering the lower belt 14 on the lower carriage assembly U will be described in detail, and it is to be understood that similar belt tensioning and steering apparatus is included in the upper carriage assembly.

Figure 6:
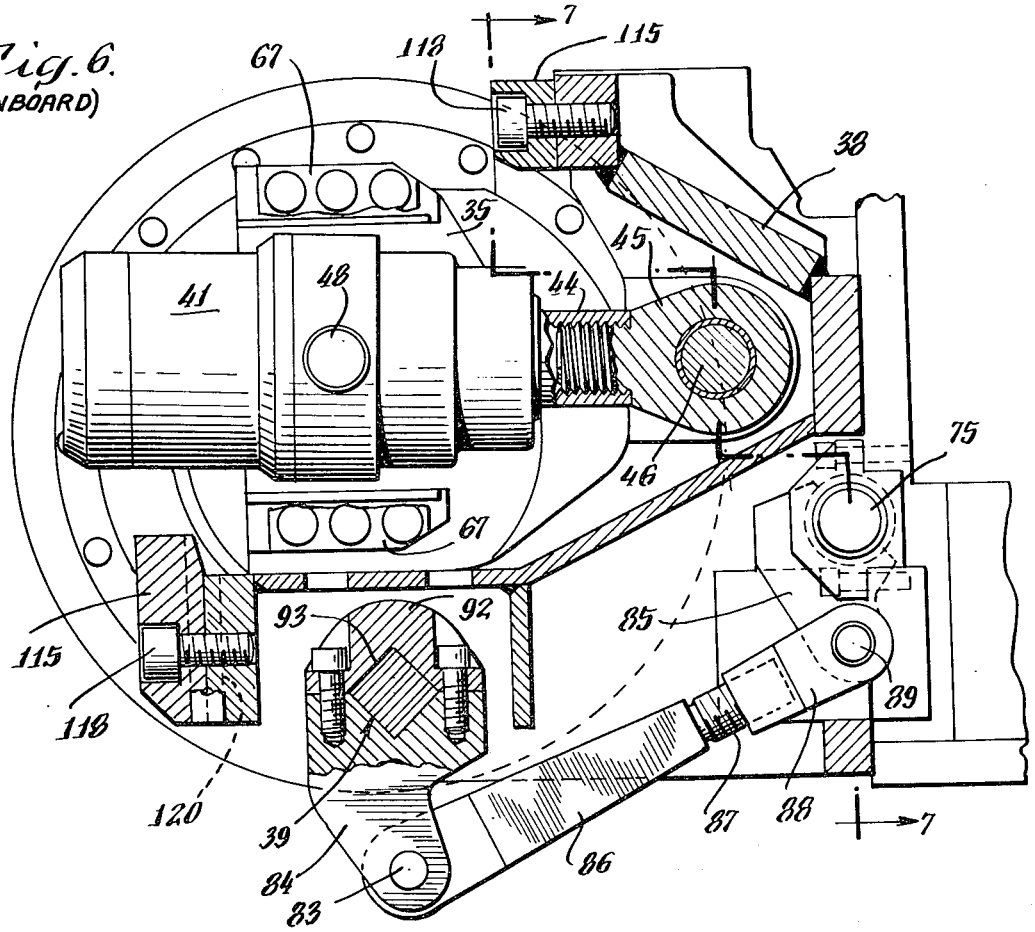
FIG. 6 is an enlarged cross-sectional view taken along the line 6—6 in FIG. 3 looking toward the left.

To maintain consistent accurately set belt tension on the lower carriage assembly, the downstream or tension pulley roll 22 (FIGS. 3 and 4) is made hollow and is mounted concentrically on a strong torque-tube squaring shaft 34 rigidly secured to both the inboard and outboard torque arms 35 (FIG. 6) and 36 (FIGS. 10, 11 and 13), respectively. These torque arms 35 and 36 are pivotally mounted on the frame 38 of the lower carriage by inboard and outboard pivot shafts 39 (FIG. 8) and 40 (FIGS. 12 and 13), respectively.

The pivoted squaring shaft torque-tube 34 serves to keep the torque arms 35 and 36 exactly parallel with each other so that they always move equally and each is always in the same relative position with respect to the frame 38. Thus, the inboard and outboard edges of the belt 14 are always maintained under equal lengths of travel. By virtue of the fact that this torque tube squaring shaft 34 extends through the hollow roll 22, the symmetrical steering apparatus and symmetrical tensioning apparatus are both applied to the same downstream roll 22 and a large amount of space is conserved within the carriage assembly.

In order to apply tension to the casting belt 14, the two torque arms 35 and 36 together with the squaring shaft 34 are urged in the belt tensioning direction by consistent, predictable symmetrical force applying means 41 and 42 acting over the full range of tensioning travel. This force applying means may be embodied as a pair of matched coil or air springs with screw jack adjustment. In this illustrative embodiment, the consistent, predictable force applying means comprises inboard and outboard fluid power cylinders 41 and 42 (FIG. 4) situated at extreme ends of squaring shaft assembly 34, 35, 36 with each cylinder rod 44 having its end 45 pivoted by a clevis pin 46 to the carriage frame 38. The fluid cylinder 42 at the outboard end of the tension pulley assemblies is mounted by trunnions 48 in its respective torque arm 36 and cylinder support cap 50. The fluid cylinder 41 at the inboard end of the tension pulley assembly is mounted by trunnions 48 in its respective torque arm 35 and combination cylinder support cap and axial thrust member 51.

Figure 13:
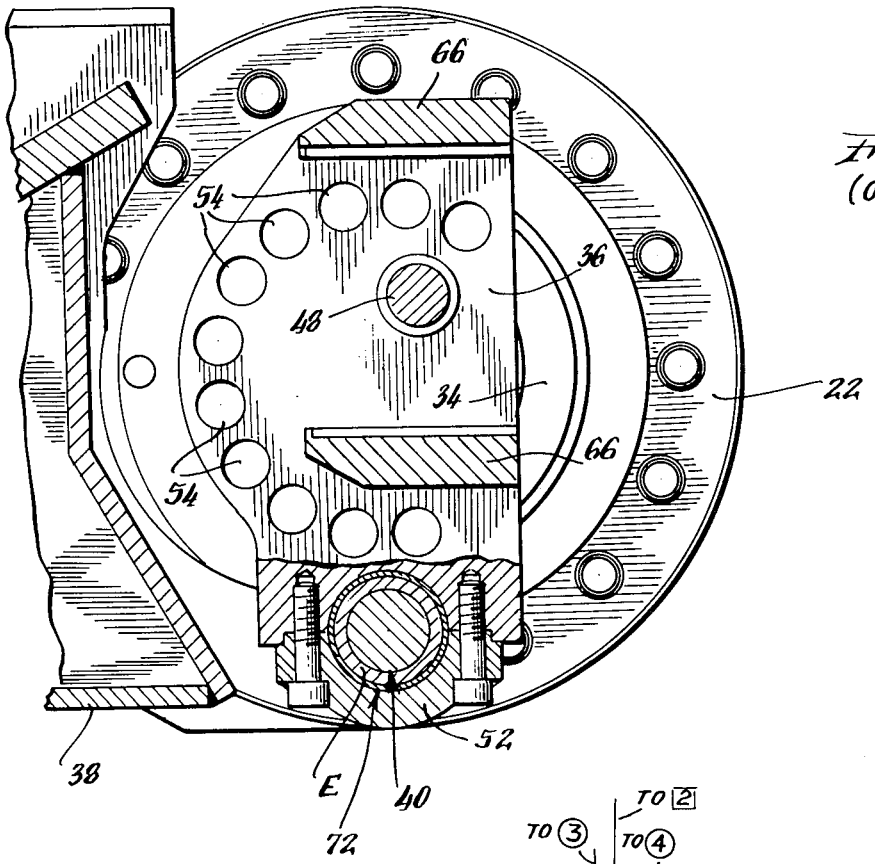
FIG. 13 is a cross-sectional view taken along the line 13—13 in FIG. 3 showing the outboard tension pivot and main roll and downstream end portion of the lower carriage.

To provide accurate tracking of the casting belt 14 on its related pulley rolls 20 and 22, the tension pulley 22 complete with its squaring shaft 34, torque arms 35 and 36, torque arm bearing caps 52 (FIG. 3), cylinder support caps 50 and 51, and fluid cylinders 41 and 42 is symmetrically skewed in a plane perpendicular to the plane of the moving mold C by opposed rotation of the combined pivot and eccentric shafts 39 (FIG. 8) and 40 (FIGS. 12 and 13). The symmetrical skewing of the tension pulley roll 22 relative to the nip pulley roll 20 modifies the belt angle of approach to the tension pulley roll and nip pulley roll and provides accurate tracking or steering of the wide casting belt 14 on these related pulley rolls.

The steering apparatus to accomplish the opposed rotation of the eccentric pivot shafts 39 and 40 and resulting symmetrical skewing action of the tension pulley assembly will be explained in detail further below.

Figure 9:
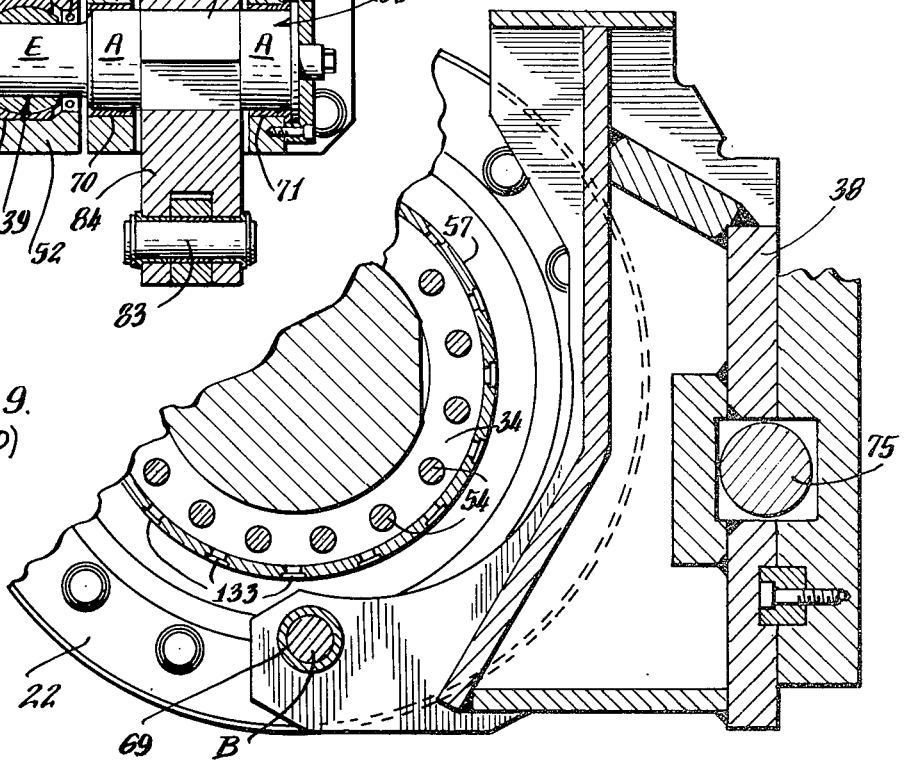
FIG. 9 is a cross-sectional view of the lower main downstream roll taken along the line 9—9 in FIG. 3 looking toward the left.

For optimum tensioning and steering of the casting belt 14, the center distance between the nip pulley roll 20 and tension pulley roll 22 is maintained consistently across the complete face width of these pulleys for all positions of the tension pulley assembly and for all steering conditions from the neutral skew position to maximum skewed positions in either direction. The rigid construction of the squaring shaft 34, the two torque arms 35 and 36, and mating caps 51 and 50, and the high torque capacity rigid joint between the squaring shaft 34, and torque arms 35 and 36 provided by the multiple cap screws 54 (FIGS. 9, 11 and 13) assures accurate maintenance of consistent pulley center distance across face width of the pulley rolls under all operating conditions even with substantial differential belt tension occurring across the width of the casting belt.

The tension pulley roll 22 rotates freely about its related squaring shaft 34 being supported for withstanding large weight effects arising from the metal product and pulley assembly weights plus the belt tension radial loads by two large diameter anti-friction bearings 56 (FIG. 4) assembled on eccentric sleeves 57 (FIG. 4) which are mounted on the squaring shaft 34. One of these anti-friction bearings 56 is also used as a 2-directional axial thrust bearing to contain any resulting axial thrust forces between the tension pulley roll 22 and the squaring shaft 34. It is preferred that this bearing 56 which contains the axial thrusts be the one located near the centering skewing master thrust assembly 104.

These anti-friction bearings 56 are each sealed against ingress of casting machine liquid coolant and foreign material by a seal 58 with cooperating sealing components. Each bearing 56 can be lubricated through a passage 60 (FIG. 4) and maintenance of the lubricant in the bearing is assured by an internal seal 61 with cooperating sealing members.

Figure 4:
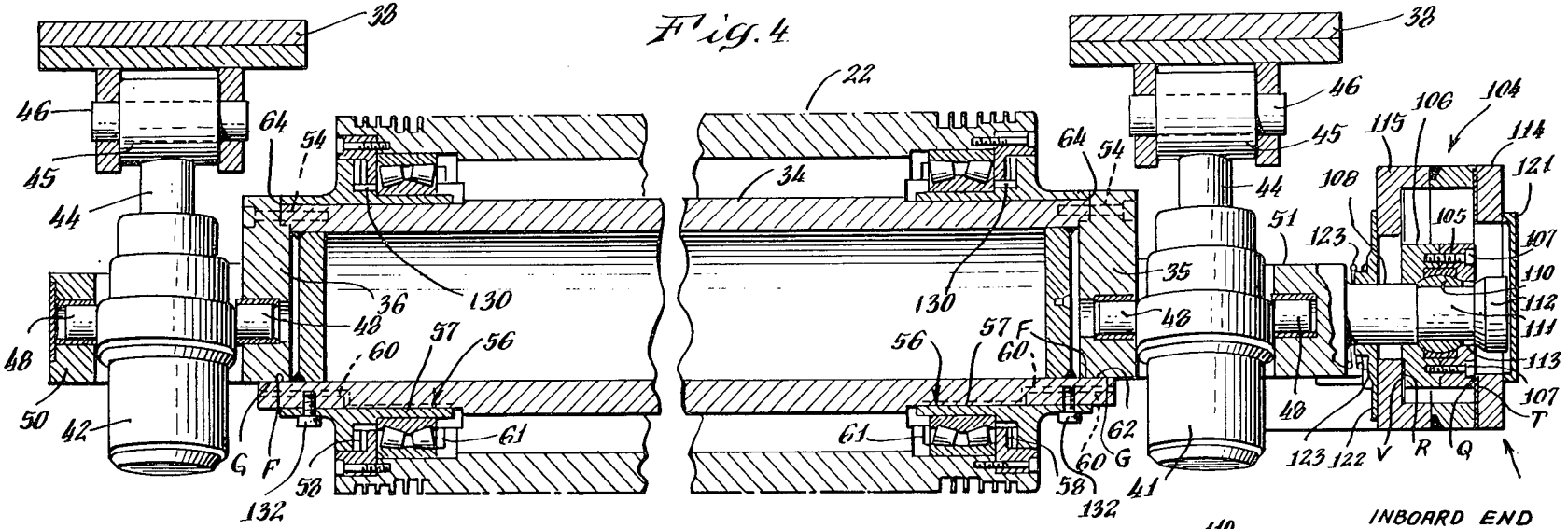
FIG. 4 is a plan sectional view of the apparatus shown in FIG. 3 taken along the line 4—4 in FIG. 3.

The tension pulley roll 22 is assembled onto its related squaring shaft 34, anti-friction bearings 56, eccentric sleeves 57, sealing and retaining members prior to assembly of the torque arms 35 and 36 onto the ends of the squaring shaft 34 by means of the multiple cap screws 54. Mating machined reference shoulder faces extending axially at F and G (FIG. 4) guarantee accurate relative location of the two torque arms 35 and 36 as they are assembled rigidly onto the end faces of the squaring shaft 34. To eliminate any degree of looseness between the assembled shaft 34 and torque arm members (35 and 36) even when high equalizing torque is transmitted through the squaring shaft assembly formed by these members and other related auxiliary parts mentioned previously, a very rigid connection is provided at the radial joint 64 (FIG. 4). For example, this rigid joint 64 is provided by substantial compression frictional forces obtained at the radial joint 64 by tightening of the multiple cap screws 54 mentioned above, thus assuring a high torsional capacity rigid connection at this joint.

It is noted that the outboard cylinder support cap 50 is rigidly connected to the outboard torque arm 36 by a pair of vertically spaced plates 66 (FIGS. 3 and 13) extending above and below the fluid cylinder 42. Similarly, the inboard cap and axial thrust member 51 is rigidly secured to the inboard torque arm 35 by another pair of vertically spaced plates 67 (FIGS. 3 and 6) extending above and below the cylinder 41.

This strong rigid construction, as shown for the squaring shaft 34 and torque arms 35 and 36 permits convenient disassembly of the complete tension pulley roll assembly and assures accurate re-assembly of the tension pulley assembly especially with reference to maintaining the relative positions of the torque arms mounted on the squaring shaft, thus maintaining the matched center distance between nip pulley roll 20 and the tension pulley roll 22 as measured across the complete face width of these rolls.

BELT TENSION REMAINS ESSENTIALLY DIRECTLY PROPORTIONAL TO THE FLUID PRESSURE

Figure 15A:
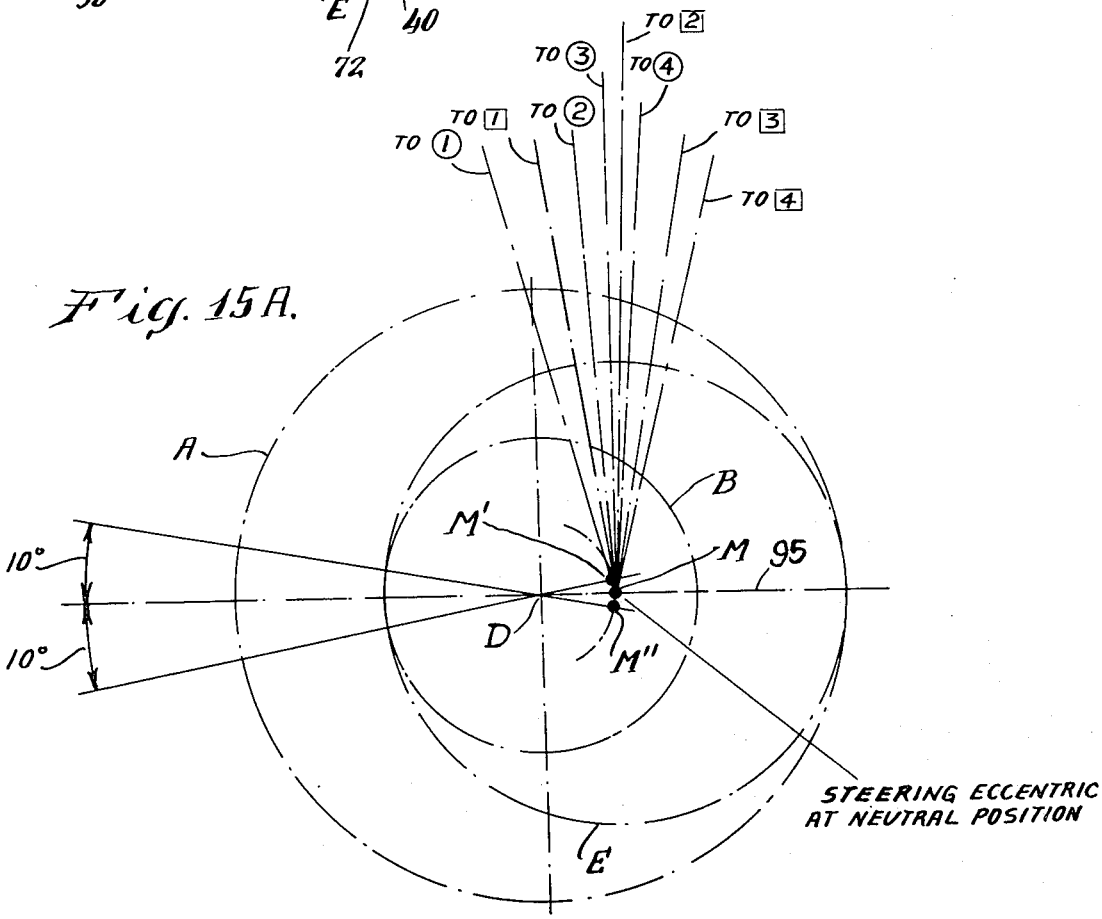
FIGS. 15 and 15A are diagrams for purposes of explanation.
Figure 15:
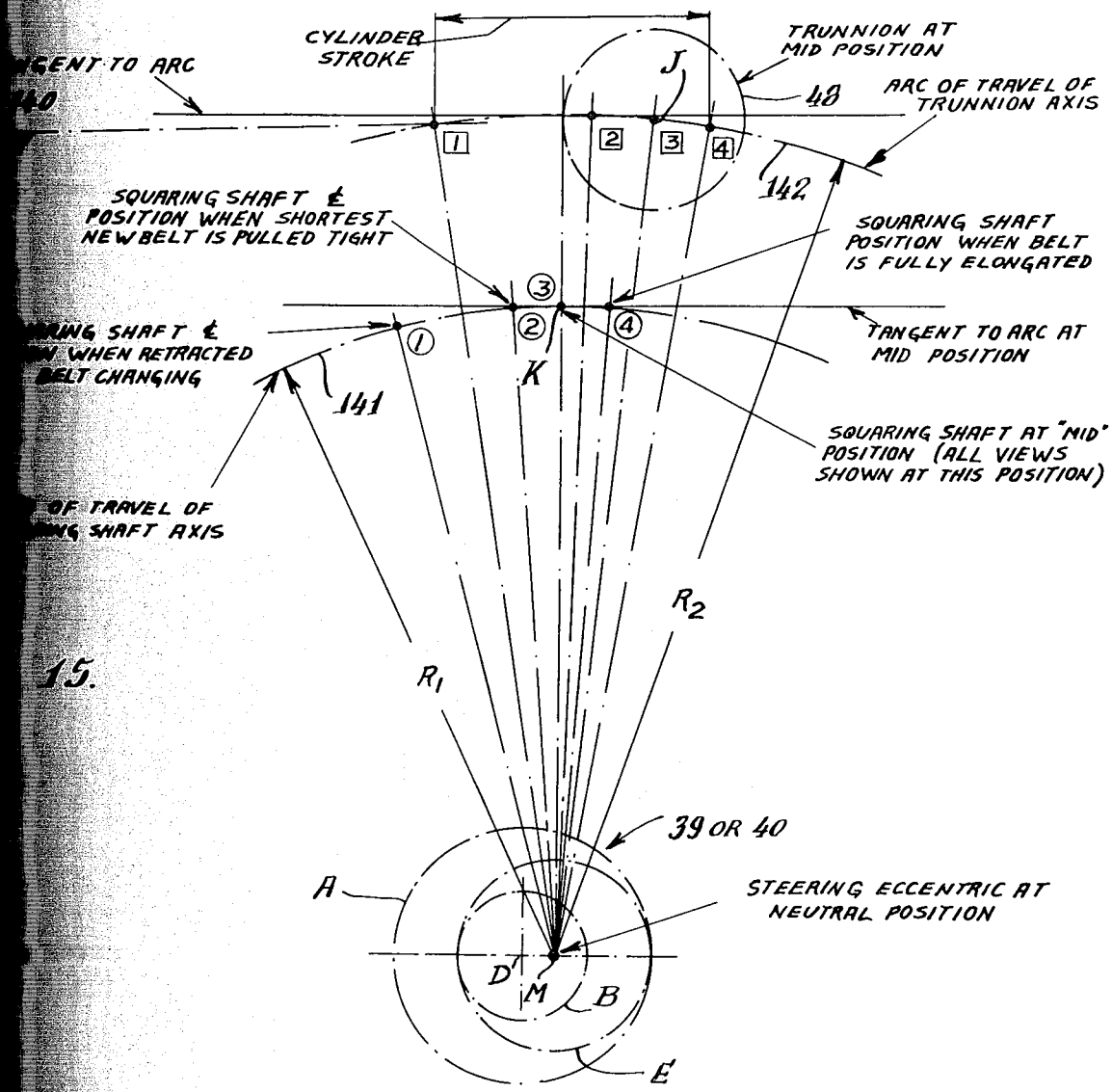

Advantageously, the tension cylinders 41 and 42 each has a line of thrust action 140 as seen in FIG. 15 which has essentially the same angular relationship with respect to a radius $R_2$ in the respective torque arms 35 and 36 from the axis of the respective pivot shafts 39 and 40 to the axis of the trunnions 48 as the angular relationship between the direction of belt tension force exerted by the taut casting belt and a smaller radius $R_1$ in the respective torque arms from the axis of the respective pivot shafts to the axis of the roll 22 on which the belt tension force is acting. Thus, essentially the same effective lever mechanical advantage is maintained for the fluid power cylinders over the full range of travel of the belt tension pulley 22. Consequently, regardless of belt length throughout the normal range, the fluid powered thrust cylinders 41 and 42 which are located at the opposite ends of the squaring shaft 34 provide belt tensioning forces at the tension pulley roll 22 proportional to the fluid cylinder pressures utilized and continuously maintained. Accordingly, this belt tensioning apparatus will advantageously, over the normal operating range, accommodate casting belts of different lengths during casting machine operation, with the belt tensioning forces applied by the tension pulley roll 22 remaining essentially directly proportional to the fluid pressure in the thrust means 41 and 42, regardless of significant variation in casting belt lengths. This means that even if the belt happens to stretch with usage, it can still be used conveniently.

In addition, the essentially constant mechanical advantage provided by this arrangement means that the operator can continue to use a given fluid pressure and be assured that the tension forces have the proper value regardless of whether the belt is new or stretched, smaller or larger.

In prior machines which utilize a toggle action, a stretched belt would allow the toggle to approach more nearly to its over-center position. Consequently, a given cylinder fluid pressure would cause a greater tension stress to occur in a stretched belt than in a new one. Whereas, in the machine, as shown herein, the tension stress imposed on the belt is always essentially the same for a given fluid pressure regardless of whether the belt is stretched or not.

These advantageous lever relationships, and the preloading discussed below, assure that essentially equal effective cylinder forces 140 are applied at both ends of the squaring shaft to be translated into essentially equal effective belt tensioning effects. In other words, a desirable symmetrical belt tensioning action is provided at both ends of the tension roll 22.

PRE-LOADING ARRANGEMENT REMOVES BACK LASH TO IMPROVE STEERING PRECISION AND ALSO PROVIDES MECHANICAL ADVANTAGE

It was noted (as seen most clearly in FIGS. 13 and 15) that the axes of the trunnions on the cylinders 41 and 42 are intentionally slightly displaced above the axis of the squaring shaft 34 for the lower tension pulley roll 22, i.e. $R_2$ is greater than $R_1$. (The axes of the corresponding upper carriage cylinders [not shown] are intentionally displaced below the axis of the squaring shaft for the upper tension pulley 18.) The larger radius $R_2$ at which the cylinder thrust 140 acts provides force multiplication for it relative to the tension force exerted at $R_1$ by the taut belt. In addition to providing this force multiplication of the cylinder thrust, this relationship provides certain small proportion of the force being exerted by these cylinders 41 and 42 as a pre-load at the pivot shafts 39 and 40. This pre-loading of the pivot shafts 39 and 40 and associated eccentric bushings 69, 70 and 71 (FIGS. 8 and 12) and self-aligning bushing assembly 72, together with the weight components of the complete tension pulley roll assembly also applied at the eccentric pivot shafts 39 and 40, eliminates all back lash at these eccentric pivot shafts 39 and 40 and related bushing parts. Thus, the selected upward displaced location of the cylinders 41 and 42 with respect to the torque arms 35 and 36 and mating cylinder caps 51 and 50 consistently pre-loads a particular load zone at the eccentric pivot shafts 39 and 40 to eliminate adverse effects of operating clearances normally required for machine parts. Thereby mechanical hysteresis is avoided to provide an advantageous steering precision.

SYMMETRICAL SYNCHRONIZED STEERING ACTION APPLIED TO BOTH ENDS OF TENSION-STEERING ROLL

Figure 14:
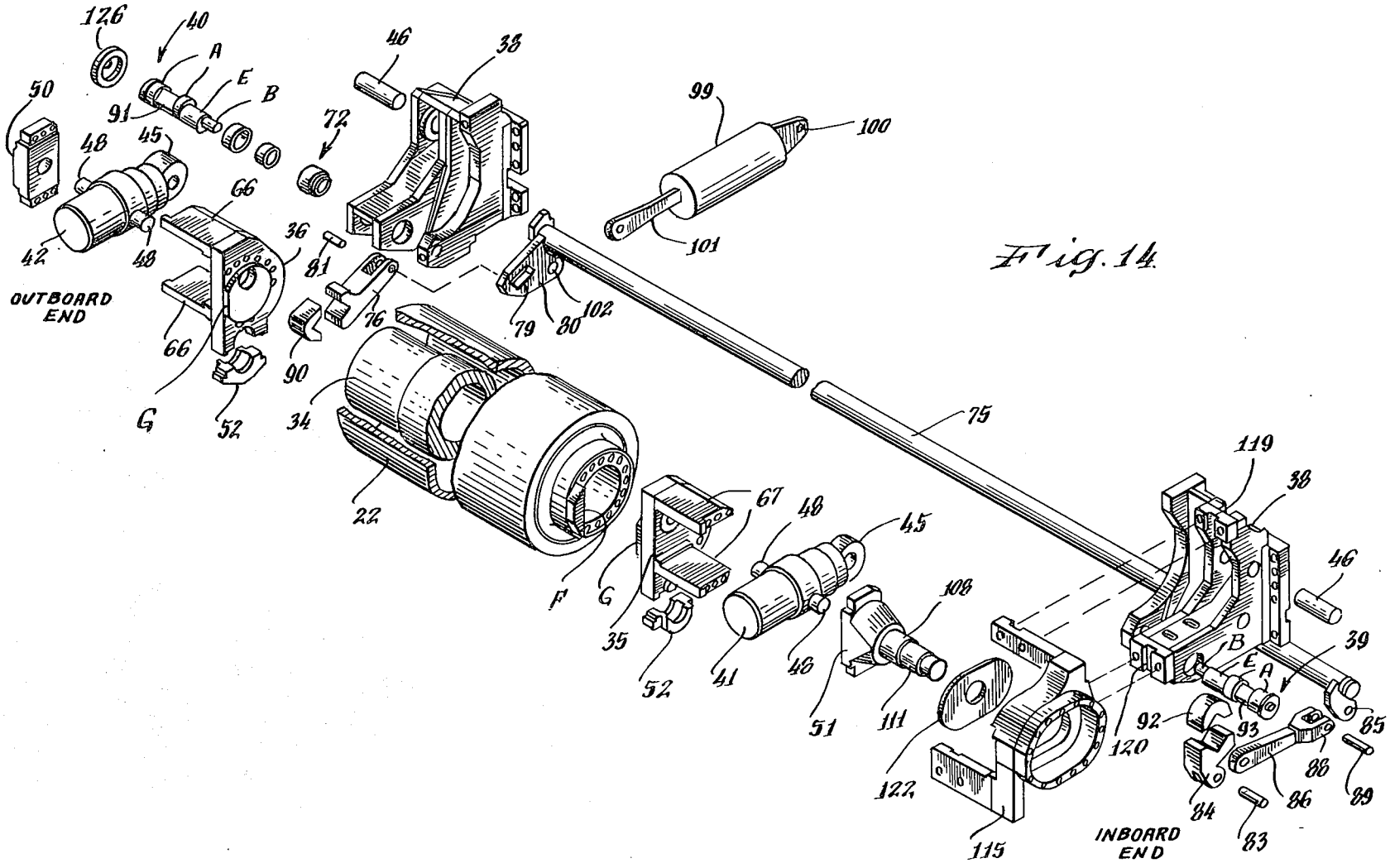
FIG. 14 is an exploded perspective view of portions of the steering and tensioning apparatus.

As illustrated in FIG. 14, synchronized opposed rotation of the two eccentric pivot shafts 39 and 40 provides controlled symmetrical skewing of the tension pulley roll 22 in a plane perpendicular to the casting plane C of the cast metal. Each pivot shaft 39 and 40 has a larger diameter concentric portion A, a smaller diameter concentric portion B, and a central portion E of intermediate diameter which is eccentric to A and B.

As shown in FIGS. 15 and 15A, both ends of the tension pulley roll 22 can be skewed by the eccentric a maximum of plus or minus approximately ⅛ of an inch from the neutral steering position. The two eccentric pivot portions E of the shafts 39 and 40 each have an eccentricity of approximately ½ of an inch relative to portions A and B and can be rotated approximately 10° above and below the neutral position to accomplish the amount of tension pulley skewing, as indicated. The torque arms 35 and 36 and bearing caps 52 (FIGS. 8 and 12) each are assembled with a self-aligning type spherical bushing assembly 72 which is seated on the central throw portion E of the eccentric pivot shafts 39 and 40. A pair of sealing members 74 (FIGS. 8 and 12) are assembled with each torque arm and bearing cap 52 to provide an enclosure for the self-aligning bushing 72 which is thereby sealed against entry of liquid coolant and foreign material. Lubrication of each eccentric pivot shaft 39 and 40 is provided through a lubrication fitting 73 to provide a relatively friction-free steering action with minimum wear on associated parts.

As shown in FIG. 15A, the limited degree of rotation of the eccentric pivot shafts 39 and 40 together with their mechanically synchronized opposed rotation which will be explained further accomplishes a very slight but equal degree of downstream-upstream movement of the tension pulley roll pivot point M at the self-aligning bushings 72. Thus, parallelism with the nip pulley roll 20 is maintained by the tension pulley roll 22 which is skewed in the plane M—K (FIG. 15) at right angles to the plane C of the cast metal. While still maintaining constant casting belt tension and length, the slight degree of downstream-upstream movement of the tension pulley roll assembly pivot points (M to M′ or M to M″) is accommodated by a very slight degree of extension and retraction of the piston rods 44 in the belt tension cylinders 41 and 42 during each complete belt steering cycle.

In the neutral position (FIG. 15A), a plane 95 through the concentric center D of the shaft portions A and B and through the center point M of the eccentric E is parallel to the casting plane C.

Mechanically synchronized opposed rotation of the eccentric pivot shafts 39 and 40 is accomplished by the steering synchronizing shaft 75 (FIG. 14). This shaft 75 actuates the outboard steering arm 76 in one direction by means of liners 77 (FIG. 11) and a sliding block 78 contained within a machined recess 79 in the outboard synchronizing arm 80 on this shaft 75. The sliding block 78 is pivotally connected by a pivot pin 81 to the outboard steering arm 76. The synchronizing shaft 75 simultaneously actuates the inboard steering arm 84 (FIG. 6) in the opposite direction by means of a synchronizing arm 85 linked by a pivot 83 and by a connecting rod 86 to the steering arm 84. The length of the connecting rod 86 is adjustable by means of a threaded end portion 86 (FIG. 6) screwed into a clevis 88 which is pivoted at 89 to the synchronizing arm 85. The outboard steering arm 76 is secured by a clamp cap 90 (FIG. 11) onto a square portion 91 (FIGS. 11, 12 and 14) of the outboard pivot shaft 40. This square portion of the shaft 40 is straddled by the two larger diameter concentric portions A. Similarly, the inboard steering arm is fastened by a clamp 92 (FIG. 6) onto a square portion 93 (FIGS. 6, 8 and 41) of the inboard pivot shaft 39.

Figure 7:
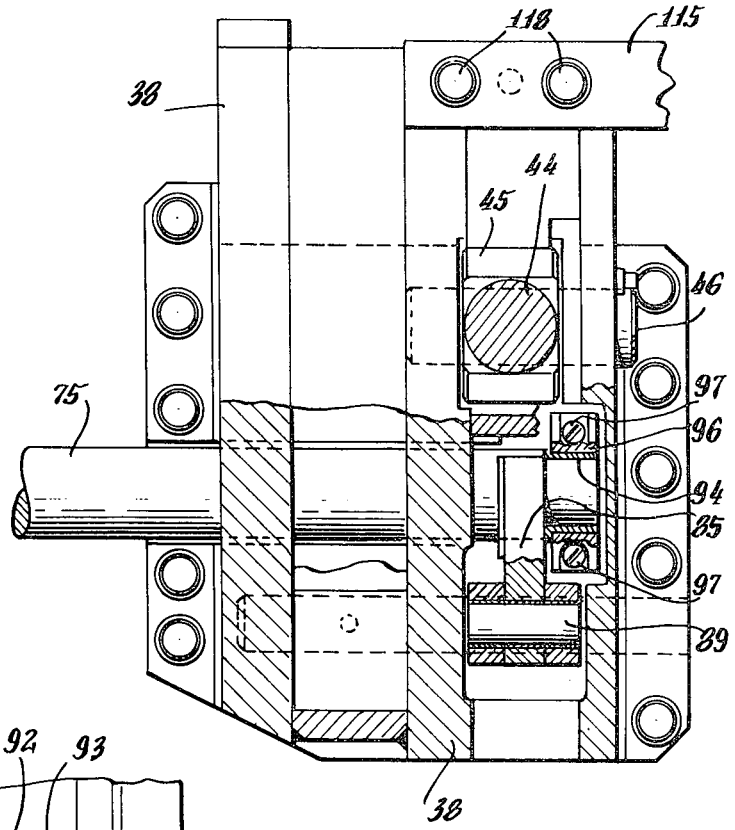
FIG. 7 is a sectional view taken along the irregular line 7—7 in FIG. 6.

The steering synchronizing shaft 75 is pivoted at its extreme ends within bushings 94 (FIG. 7) contained within pillow blocks 96 aligned and fastened to the main carriage frame structure 38 by cap screws 97. As shown in FIGS. 10 and 14, this steering synchronizing shaft 75 is actuated by a fluid power cylinder 99 pivotally connected at 100 to the outboard side of the main carriage frame structure 38, and having a piston rod 101 pivoted at 102 to the outboard synchronizing arm 80 (FIG. 11).

Thus, the outboard synchronizing arm 80 can be swung in either direction by the cylinder 99, thereby to shift the eccentric E of the inboard pivot shaft 39 up or down and simultaneously to shift the eccentric E of the outboard pivot shaft 40 down or up, respectively.

SKEWING STEERING AXIS CONTROL

In order to provide optimum casting belt steering performance, there is a steering skewing axis control assembly 104 (FIGS. 3 and 4) which causes the tension pulley roll squaring shaft 34 to be effectively skewed about the desired steering point S (see also FIG. 18) during the belt steering cycle. This steering action will be explained in further detail in connection with FIGS. 16, 17 and 18, as discussed below. This skewing control assembly 104 prevents the squaring shaft 34 from moving axially, i.e. outboard or inboard, and assures that the point of actual tilting of the shaft 34 is at the desired points and not elsewhere. The skewing control assembly 104 includes mating axial thrust blocks 105 and 106 which are fastened together by cap screws 107 and holding the extended inboard stub shaft outrigger portion 108 of inboard cylinder cap 51 through a self-aligning bushing assembly 110 seated on a reduced diameter section 111 of the extended portion 108. The bushing assembly 110 is retained by lock nut 112 and spacer ring 113. Axial control faces Q and R of the thrust blocks 105 and 106, respectively, are accurately contained by parallel thrust faces T and V on thrust flange 114 and thrust housing 115, respectively. The self-aligning bushing assembly 110 permits the mating axial thrust blocks 105 and 106 to assume proper contact with thrust housing 115 at the mating faces R and V and with the thrust flange 114 at the mating faces Q and T for all skewed steering positions and belt tensioning positions of the squaring shaft 34. The self-aligning bushing assembly 110 within the axial thrust blocks 105 and 106 is sealed against ingress of liquid coolant and foreign material by seals similar to those shown at 64 in FIG. 12. The thrust housing 115 is mounted onto the carriage frame structure 38 by cap screws 118 (FIGS. 3, 6 and 7) and accurately located and retained against axial thrust loads by keys 119 and 120. The cavity within the axial thrust housing 115 and mating thrust flange 114 is sealed at the inboard side by a housing cap 121 and at the other side by a cover plate 122 loaded by a spring 123 into sealing engagement with the housing 115.

It is to be noted that during the skewing steering movement of the squaring shaft 34 and its concentric tension pulley roll 22, the necessary axial movement of the self-aligning bushing assemblies 72 (FIGS. 8 and 12) with respect to mating eccentrics E of pivot shafts 39 and 40 occurs simultaneously with rotation of the eccentric pivot shafts, thus providing a smooth steering action. Axial thrust forces applied to each eccentric pivot shaft 39 and 40 during axial movement of its mating self-aligning bushing assembly 72 are contained by flange bushing 124 (FIGS. 8 and 12) and thrust cap 126 mounted on the frame 38 by cap screws 128.

Although actuation of steering synchronizing shaft 75, as shown, is provided by fluid power cylinder 99, other actuating means 99 for actuating this steering synchronizing shaft can be used, such as an electrically, hydraulically, or manually, driven screw jack, or electrically or hydraulically actuated torque motor applied to the shaft 75. Automatic steering or tracking of each casting belt can be provided by use of a belt edge sensor or microswitch which automatically controls a solenoid valve or electrical switch which thereby appropriately actuates the means 99 for actuating the shaft 75 to provide the necessary skewed steering motion of the squaring shaft 34 and related tension pulley roll 22, as previously described.

CONVENIENTLY REMOVABLE TENSION-STEERING ROLL AND SQUARING SHAFT ASSEMBLY

Figure 3:
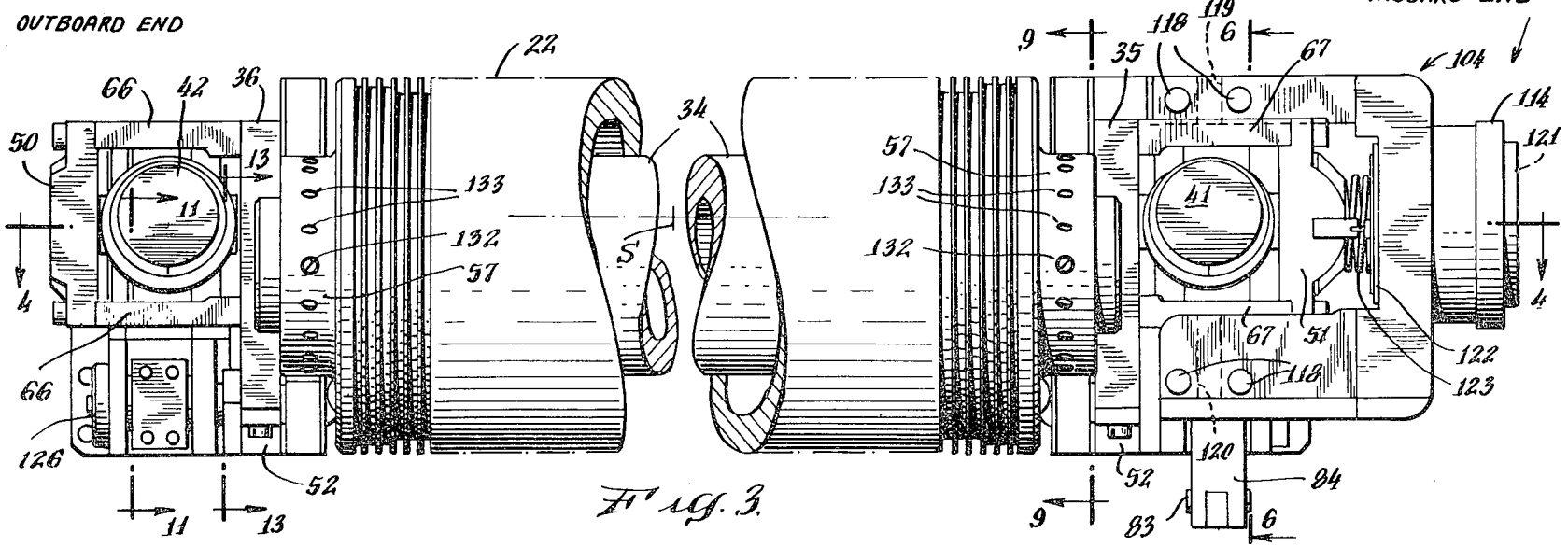
FIG. 3 is an elevational view of the downstream main roll for the lower carriage with the associated belt tensioning and steering apparatus, as seen looking upstream, with part of the roll shown broken away.

Each complete tension-steering pulley roll and squaring shaft assembly, as shown in FIGS. 3, 4 and 14, is completely pre-assembled and can be installed or removed from the casting machine 10 as a complete unit. In order to effect this removal, the two bearing caps 52 are removed from their respective torque arms 35 and 36. The two pins 46 are removed from the ends 45 of the piston rods, as seen most clearly in FIG. 14, and the skewing control thrust housing 115 is disconnected from the frame 38. The hydraulic connections (not shown) are removed from the fluid cylinders 41 and 42. Then this assembly can be removed as a complete unit for servicing, if desired.

BELT-TENSIONING RELATIONSHIPS

The action of the squaring shaft 34 and mating torque arms 35 and 36, and caps 51 and 50, swinging about eccentric pivot shafts 39 and 40, provides an arcuate motion of the tension pulley roll 22 over the full belt-tightening stroke range of thrust cylinders 40 and 41. The limited degree of arcuate motion of the tension pulley roll 22 over this operating range has no adverse effect on the related casting belt as it is to be noted that the circumference of the tension pulley roll is intentionally displaced to a small extent away from casting pass line. Moreover, the axis of each pivot shaft 39 and 41 is in a plane perpendicular to the casting pass line through the "mid" operating position of the roll so that there is only a very limited up-down motion of the portion of the steering-tensioning roll near the pass line.

FIGS. 15 and 15A show the geometrical relationships of the movable members during belt-tensioning action. H indicates the axis of the clevis pin 46, and J indicates the axis of the trunnions 48 of the cylinder thrust means 41 or 42 at the so-called mid-position. This mid-position J corresponds with the mid-position K of the axis of the squaring shaft 34, which is defined as being the position when a radius from the axis M (see also FIG. 15A) of the eccentric E to point K is perpendicular to the plane of the casting region C. All of the figures show the respective parts in this so-called mid-position. Also, this mid-position K is approximately midway between the positions occupied when the shortest new belt is taut or the longest used belt is taut.

A and B indicate the concentric portions of the pivot shaft 39 or 40, and E indicates the eccentric portion. In FIG. 15, the point M is shown with the eccentric E at the neutral position. In FIG. 15A, which is drawn full size, it can be seen that during the symmetrical steering action the axis M of the eccentric E can be swung approximately 10° above and below the neutral position, as indicated at M′ and M″, respectively.

The cylinder thrust means 40 and 41 deliver thrust along the line of action 140 which passes through points H and J. The axis K of the squaring shaft 34 can be swung along an arc 141 which is at a radius $R_1$ from axis M. To produce this motion, the trunnion axis J is swung along an arc 142 at a radius $R_2$ from point M.

The respective positions of the axis K along the arc 141 are shown by the numbers 1, 2, 3 and 4 drawn within small circles. The corresponding respective positions of the axis J are shown by these same numbers drawn within small squares.

The positions 1 (square) and 1 (circle) occur when the cylinder thrust means 40 and 41 are fully retracted to retract the squaring shaft 34 for removal and replacement of the casting belt 14.

The positions 2 (square) and 2 (circle) are occupied when the shortest new belt is pulled taut.

The positions 3 (square) and 3 (circle) are the mid-positions discussed above.

The positions 4 (square) and 4 (circle) are reached when a used casting belt has been fully elongated.

Figure 5:
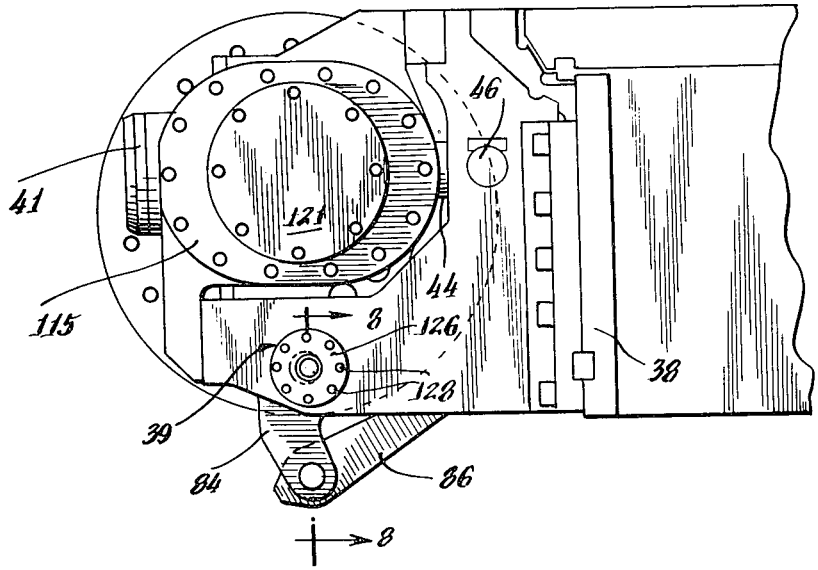
FIG. 5 is an elevational view of the apparatus as seen from the right in FIG. 3, i.e. an elevational view of the inboard end.

The belt tensioning cylinders 41 and 42 intentionally do not extend (as seen in FIGS. 5 and 10) beyond a projection of the belt path line established by the nip pulley roll 16 or 20 and the tension pulley roll 18 or 22 on each respective carriage assembly to facilitate installation and removal of the casting belts 12 and 14 from the outboard side of the casting machine without mechanical interference.

As shown in FIG. 10, a pointer 134 mounted on the outboard cylinder support member 50 cooperates with a related scale 135 mounted on the frame of the carriage to indicate the precise extended position of the tension pulley roll. This pointer and scale are calibrated to continuously indicate the actual stretched length of the casting belt on the carriage assembly while the machine 10 is in operation. This reading can conveniently be observed by the operator.

INDEPENDENT ADJUSTMENT OF DISPLACEMENT OF EACH END OF TENSION-STEERING ROLL FROM THE PASS LINE

Variable selected setting of the degree of displacement (or clearance) of the circumference of the tension pulley roll 22 with respect to the casting pass line C is provided by the eccentric sleeves 57 (FIG. 4) and associated eccentric rings 130 each of which has its machined inside diameters eccentrically located with reference to their respective concentric outside surfaces. Adjusting each of the sleeves 57 and its interlocking ring 130 to a particular angular position with reference to the squaring shaft 34 and subsequently locking each sleeve 57 to the squaring shaft 34 by means of a shoulder screw 132 (FIG. 4) in a screw hole 133 sets the angular position of the eccentricity offset between the axis of the tension pulley roll 22 and the axis of the squaring shaft 34. There are multiple screw openings 133 (FIGS. 3 and 9) in each sleeve 57 to facilitate this adjustment. Accordingly, the circumference of tension pulley roll 22 is set at a predetermined amount of offset (clearance) from the casting pass line C (FIG. 2). This clearance is adjusted when the eccentrics E are in their neutral steering position and the axis K of the roll is at its mid-position 3. By virtue of the fact that clearance adjustment means 57, 130, 132, 133 are provided at both ends of the squaring shaft 34, the axis of the pulley roll 22 can be set precisely relative to the axis of the squaring shaft 34, so that the roll is in a balanced position to provide the same amount of clearance at both ends.

FURTHER EXPLANATION OF SYMMETRICAL SYNCHRONIZED SKEWING STEERING ACTION

Figure 8:
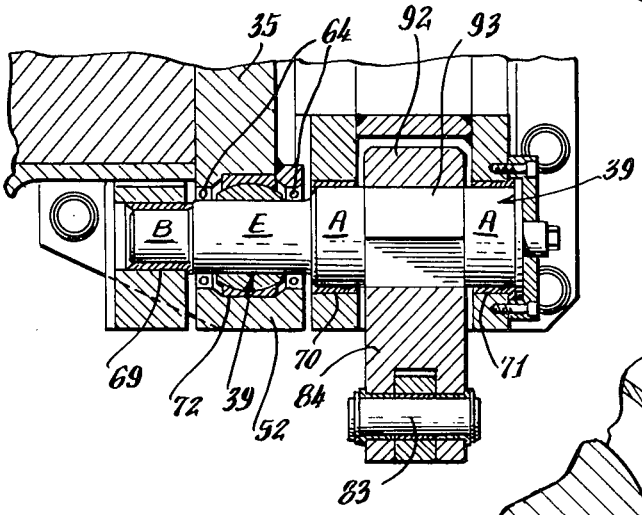
FIG. 8 is a sectional view taken along the line 8—8 in FIG. 5.
Figure 16:
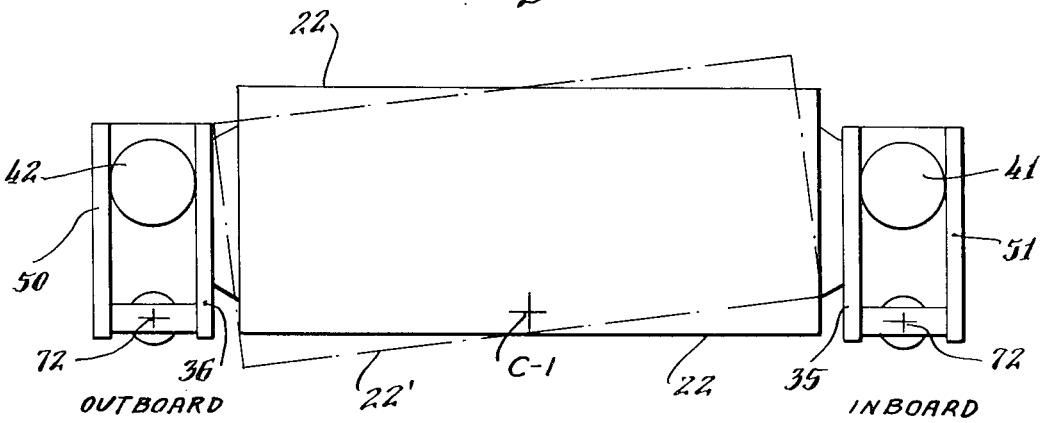
FIGS. 16, 17 and 18 are diagrammatic elevational views, corresponding generally to FIG. 3, showing the downstream main roll and associated belt tensioning and steering apparatus schematically illustrated for purposes of explanation.

In order to explain the function of the centering skewing assembly 104, attention is invited to FIG. 16 which is a schematic diagram elevational view corresponding generally to FIG. 3, except that the assembly 104 has been omitted. The cross marks at 72 diagrammatically indicate the centers of the respective self-aligning bushings associated with the inboard and outboard eccentric pivot shafts 39 and 40 (FIGS. 8 and 12). In the absence of the centering skewing assembly 104, the action of the eccentric pivot shafts in conjunction with the self-aligning bushings 72 would be to tend to skew the squaring shaft 34 together with the steering roll 22 about a point C-1 mid-way between the bushing points 72. Thus, as shown very much exaggerated at 22' in FIG. 16, it would be the upper portion of the roll 22 which would tend to swing back and forth producing a greatly unequal skewing effect on the top and bottom portions of the casting belt as well as twisting the fluid power cylinders 41 and 42 sideways. This sideways component of motion of the cylinders 41 and 42 would tend to bind their piston rods.

Figure 17:
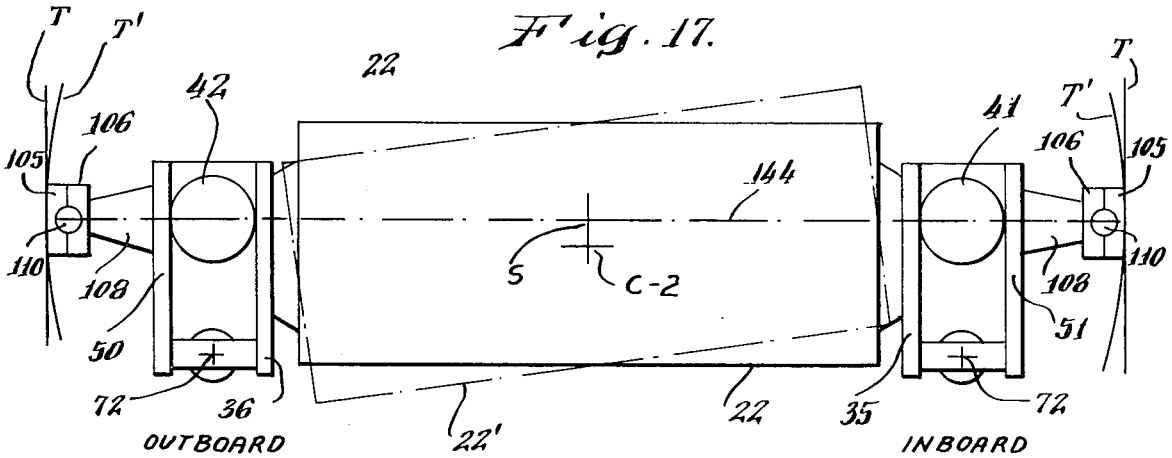
Figure 18:
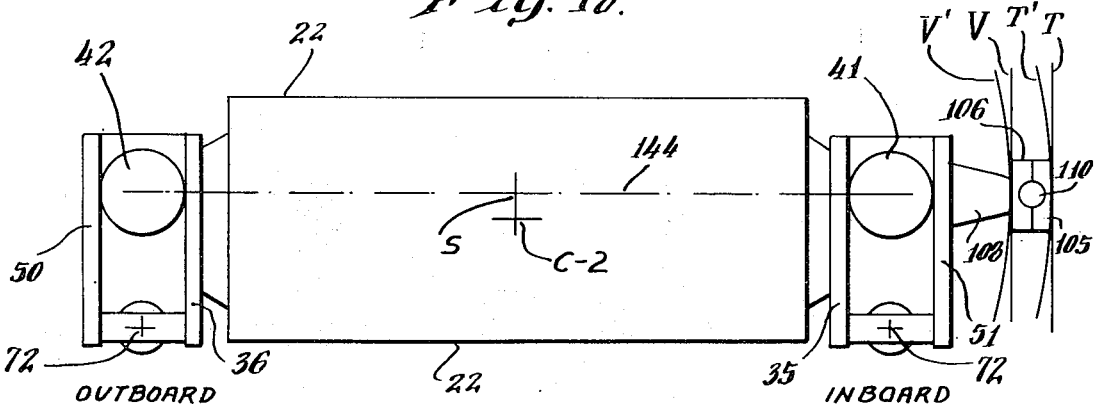

As shown in FIG. 17, it is theoretically desirable to skew the roll 22 about a point C-2 located at its center on its axis of rotation, because this would equally skew the top and bottom portions of the casting belt. However, since the centers of the fluid power cylinders 41 and 42 are located at a level above the level of the center C-2, there would still be a sideways component of motion of the fluid cylinders 41 and 42.

Accordingly, in considering these conflicting factors, it has been determined that the optimum location for the center of skewing is at a point S mid-way between the thrust cylinders 41 and 42.

It is the function of the centering skewing assembly 104 to cause the center of skewing to be symmetrically located at the point S on a line 144 joining the centers of the cylinders 41 and 42. In order to explain the operation of assembly 104, it is helpful to assume that outriggers 108 are attached to both the inboard and outboard cylinder trunnion support members 50 and 51 and that spherical bushing assemblies 110 and thrust blocks 105, 106 are carried by both outriggers. The centers of the spherical bushings 110 are located on the line 144 passing through point S and through the centers of the cylinders 41 and 42.

If fixed curved thrust surfaces T' concentric about point S are located in sliding contact with the respective thrust blocks 105 at both ends of the roll 22, then the roll 22 is forced by these concentric curved thrust surfaces T' to skew about the center S. Since the amount of skewing movement is small relative to the width of the roll 22, or relative to the length of the distance 144, the angular turning movement about point S is small, and so the curved thrust surfaces T' can be replaced by the flat thrust surfaces T perpendicular to the plane of the casting region. (In other words, for the very small angles involved sine and tangent functions are essentially equal. Thus, the curved surfaces T' can be replaced by the straight surfaces T.)

Instead of using two outriggers 108, it is advantageous to use only a single outrigger attached to the inboard trunnion support member 51. This outrigger carries a spherical bushing 110 and the mating thrust blocks 105 and 106. The spherical center of the bushing 110 is located on the line 144 passing through point S and through the centers of the thrust cylinders 41 and 42. Then, two fixed curved thrust surfaces T' and V' are provided concentric about S and in sliding contact with the thrust blocks 105 and 106. In effect, the thrust blocks 105 and 106 are captured between these two curved thrust surfaces T' and V', and thus the roll 22 is forced to skew about the center S.

Once again, since the amount of skewing movement is small relative to the width of the roll 22 and relative to the length of the line 144, the pair of fixed curved thrust surfaces T' and V' can be replaced by the plane parallel surfaces T and V perpendicular to the plane of the casting region C (and also perpendicular to the line 144 passing through the point S). During steering, one of the steering pivot points 72 moves down or up and the other steering pivot point 72 moves equally up or down while positive guidance is provided by the two thrust surfaces T and V acting with respect to a spherical bearing 110 on the line 144 through center point S. The result is symmetrical skewing steering action about the desired center point S.

The surfaces T and V are provided by the thrust flange 114 and thrust housing 115 of the centering skewing thrust assembly 104 which is fixed in position by being attached to the lower carriage frame by the screws 118 and keys in the fixed keyways 119 and 120, as explained above. The respective surfaces Q and R of the thrust blocks 105 and 106 slide against these thrust surfaces T and V.

It is advantageous to locate the centering skewing thrust assembly 104 on the inboard side of the carriage because it leaves the outboard side less cluttered, thereby facilitating operation. However, it is noted that the assembly 104 can be located on the outboard side. If desired, a pair of thrust assemblies similar to the showing in FIG. 17 can be used.

It is noted that the synchronizing arms 80 and 85 (FIG. 14) at the outboard and inboard ends of the synchronizing shaft 75 are effectively at right angles to each other as seen looking in a direction parallel with the axis of the shaft 75. The inboard synchronizing arm 85 exerts a push-pull action on its connecting rod 86 which swings the steering arm 84. The outboard steering arm 80 exerts a direct swinging action on its steering arm 76, and there is no connecting rod involved. Thus, the outboard steering arm 76 is swung in the opposite direction from the inboard steering arm 84. They are moved equal amounts in opposite directions when the synchronizing shaft 75 is turned.

CONCLUSION

The present invention may be embodied in twin-belt metal casting machines having belt widths of 116 inches or more for casting slabs of 100 inches in width or more. The belt driving roll 16 or 20 at one end of the carriage U or L and the tension-steering roll 18 or 22 at the other end of the carriage define symmetrical oval-shaped paths, as seen in FIG. 2, for the respective casting belts 12 or 14. These rolls are of large diameter, for example, 30 inches or more in diameter, such that high tension forces can be applied to the belts, for example, these tension forces may be in the range from 8,000 up to 20,000 or more pounds per square inch of belt cross section. With a belt having a thickness in the range from approximately 0.040 to approximately 0.060 of an inch and a width of 116 inches at a tension of 20,000 p.s.i., the tension force is in the range from approximately 90,000 pounds to 140,000 pounds for each belt path, which accordingly requires a total tension force of 180,000 pounds to 280,000 pounds to be applied by each tension-steering roll.

The lower carriage L may be made slightly longer, for example, one-half of an inch longer, than the upper carriage. This means that some of the new casting belts are made approximately one-half inch larger. The slight differential enables new belts to be nested inside of each other for convenience in storage and shipping.

Because of the adverse environment and high temperature conditions under which many casting machines must operate, and to minimize wear and corrosion of critical surfaces, the features and advantages described herein provide a minimum number of exposed sliding surfaces.

It is to be understood that because of these adverse operating conditions, such as moisture and condensation, the structures described herein incorporate wear and corrosion-resistant materials.

We claim:

1. A symmetrical synchronized belt-steering system for use in a twin-belt continuous metal casting machine of the type in which a casting region is defined between spaced parallel portions of the two casting belts, said system comprising:

a frame for supporting and revolving a casting belt, said frame having a pair of main rolls at opposite ends, said rolls extending parallel to each other and also parallel to the plane of the casting region for defining an oval shaped path around which the casting belt is revolved, a first and second bearing for supporting one of said rolls, said first bearing being located near one end of said one roll and said second bearing being located near the other end of said one roll for allowing for rotation of said one roll first and second mounting means positioned on opposite sides of the frame and associated with said first and second bearings, respectively, for mounting them on the frame, first and second steering means positioned on opposite sides of the frame for moving said first and second mounting means, respectively toward and away from the plane of the casting region for steering the belt, and synchronizing means connected between said first and second steering means for causing said first and second mounting means simultaneously to move equal amounts in opposite directions effectively toward and away from the plane of the casting region when said synchronizing means are actuated for skewing said one roll symmetrically with respect to the frame for steering the casting belt.

2. A symmetrical synchronized belt-steering system for use in a twin-belt continuous metal casting machine as claimed in claim 1, in which:

said synchronizing means is a movable shaft extending across the frame and interconnecting said first and second steering means for producing equal and opposite action of said first and second steering means.

3. A symmetrical synchronized belt-steering system for use in a twin-belt continuous metal casting machine as claimed in claim 1, in which:

skewing axis control means are mounted on said frame, and said skewing axis control means are effectively coupled to said first mounting means for said first bearing for controlling the point about which said one roll is skewed by said first and second steering means.

4. A symmetrical synchronized belt-steering system for use in a twin-belt continuous metal casting machine as claimed in claim 3, in which:

said skewing axis control means includes first and second thrust surfaces facing in opposite directions and extending perpendicular to the plane of the casting region, thrust block means in sliding contact with said thrust control surfaces, and said thrust block means being connected to said first mounting means at a predetermined location thereon for causing said location of the mounting means to move in a direction perpendicular to the plane of the casting region.

* * * * *